US005257023A

United States Patent [19]

Furuya

[11] Patent Number: 5,257,023

[45] Date of Patent: Oct. 26, 1993

[54] ONBOARD ROAD MAP DISPLAY SYSTEMS

[75] Inventor: Hiroaki Furuya, Kanagawa, Japan

[73] Assignee: Nissan Motor Co., Ltd., Japan

[21] Appl. No.: 854,033

[22] Filed: Mar. 19, 1992

[30] Foreign Application Priority Data

Mar. 28, 1991 [JP] Japan ..... 3-90045

[51] Int. Cl.[5] ..... G08G 1/123

[52] U.S. Cl. ..... 340/995; 340/905; 364/436

[58] Field of Search ..... 340/995, 905, 990; 455/186.1, 228; 364/437, 438, 436, 424.01, 449, 444

[56] References Cited

U.S. PATENT DOCUMENTS

| | | | |
|---|---|---|---|
| 4,409,583 | 10/1983 | Dahan et al. | 340/995 |
| 4,608,656 | 8/1986 | Tanaka et al. | 340/995 |
| 4,737,927 | 4/1988 | Hanabusa et al. | 340/995 |
| 5,182,555 | 1/1993 | Sumner | 340/905 |

FOREIGN PATENT DOCUMENTS

| | | | |
|---|---|---|---|
| 2-71877 | 5/1990 | Japan . | |
| 4-40596 | 2/1992 | Japan | 340/905 |
| 9005969 | 5/1990 | World Int. Prop. O. | 340/905 |

*Primary Examiner*—Brent Swarthout

*Attorney, Agent, or Firm*—Lowe, Price, LeBlanc & Becker

[57] ABSTRACT

A road map display system mounted on a vehicle for navigation guidance is arranged to discriminate monitored roads in which traffic conditions are monitored, from unmonitored roads, and to provide reliable information on traffic congestion to a driver of the vehicle. The road map display system includes a display device and a map image processor which controls the display device to display a road map image of the monitored roads distinguished from the unmonitored roads. Preferably, the display system includes a selector switch for selecting one of a normal display mode in which all roads are displayed around a current vehicle position, and a second display mode in which only the monitored roads are displayed with stepwise gradation to indicate degrees of congestion.

15 Claims, 8 Drawing Sheets

| MESH NUMBER | LINK NUMBER | AVERAGE SPEED |
|---|---|---|
| 533934 | 00369845 | 20 |
| 533934 | 00498874 | 32 |
| 533934 | 01596425 | 18 |
| 533934 | 02465963 | 26 |
| 533944 | 00150064 | 34 |
| 533944 | 00870359 | 24 |
| ⋮ | ⋮ | ⋮ |
| ⋮ | ⋮ | ⋮ |

FIG. 7

| CONGESTED ROAD REPRESENTATION STYLE | AVERAGE SPEED (Sa) |
|---|---|
| | Sa ≥ 40Km/h |
| | 30Km/h ≤ Sa < 40Km/h |
| | 20Km/h ≤ Sa < 30Km/h |
| | 10Km/h ≤ Sa < 20Km/h |
| | Sa < 10Km/h |

ONBOARD ROAD MAP DISPLAY SYSTEMS

BACKGROUND OF THE INVENTION

The present invention relates to an onboard road map display system for providing information on road map and traffic situations to a driver of a vehicle such as a motor vehicle.

Japanese Utility Model Provisional Publication No. (Hei)2-71877 shows a conventional road map display system which displays a map of roads by using a series of different graphic styles indicating possible vehicle speed levels determined by degrees of traffic congestion. In this conventional road map display system, however, roads in which traffic conditions are not monitored are not discriminated from monitored roads about which traffic information is available. A commonly assigned U.S. patent application Ser. No. 07/795,592 shows a similar navigation system having a road map display unit. This application is still pending and kept in confidence.

SUMMARY OF THE INVENTION

It is an object of the present invention to provide an onboard road map display system which can provide reliable traffic information.

An onboard road map display system according to the present invention comprises at least a communicating means, a map displaying means and an image processing means. The communicating means is a means for performing communication such as radio communication to obtain traffic information such as information on traffic congestion. The map displaying means is a means for producing a visual road map imagery. The processing means is a means for causing said displaying means to display a road map imagery so that monitored roads which are monitored to provide traffic information are distinguished from unmonitored roads which are not monitored. Therefore, the driver can perceive a route which is surely free from traffic jams.

In one embodiment of the invention, the road map display system further comprises a display mode selecting means for selecting one of a normal road map display mode (first mode) in which a map image of roads around a current vehicle position is displayed, and a congestion display mode (second mode) in which a map image of only the monitored roads around the current vehicle position is displayed, and a map storing means, such as a CD-ROM system, for storing map data representing a map of roads.

It is another object of the present invention to provide a road-vehicle communication system which comprises a road system for monitoring traffic situations on monitored roads and transmitting traffic information, and an onboard road map display system for receiving the traffic information from the road system and providing visual information on roads and traffic conditions to a driver of the vehicle.

BRIEF DESCRIPTION OF THE DRAWINGS

FIG. 7 is a table showing graphic styles for representing roads in a display device of the display system of FIG. 2.

DETAILED DESCRIPTION OF THE INVENTION

Figure 2:
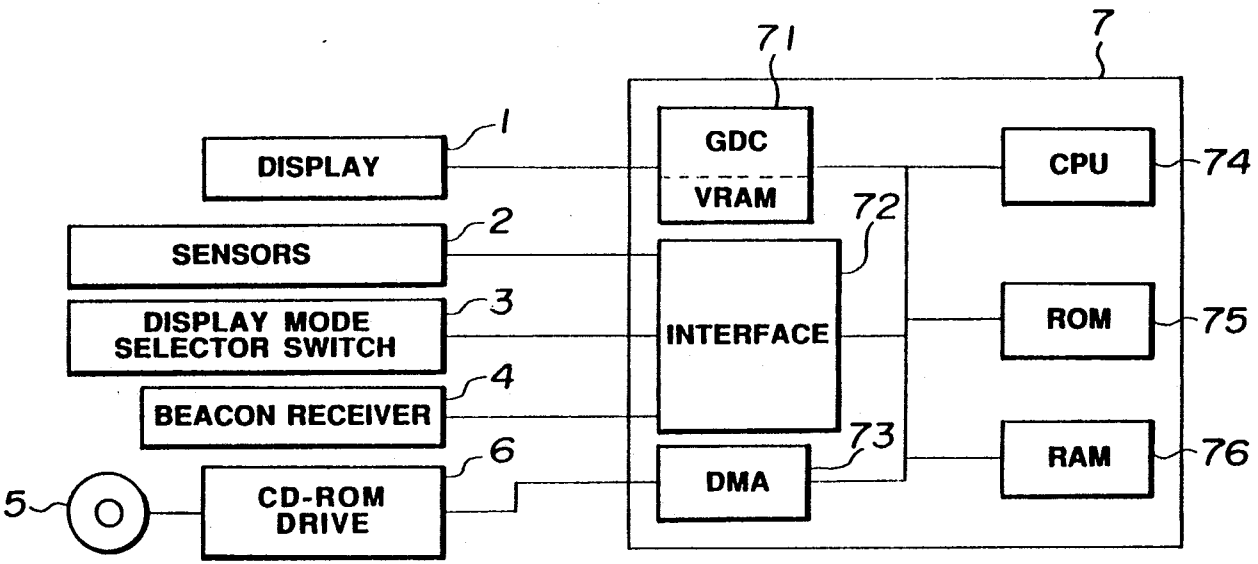
FIG. 2 is a block diagram showing an onboard road map display system according to a first (or second) embodiment of the present invention.

FIG. 2 shows an onboard road map display system according to a first embodiment of the present invention.

This map display system (or navigation and information system) of this embodiment includes a display unit 1 for producing visual road map images, a sensor group 2 for sensing travel direction and travel distance of the vehicle on which this display system is mounted, a display mode selector switch 3, a beacon receiver 4, and a CD-ROM driver 6 for driving a CD-ROM disc (or CD-ROM discs) 5 storing road map data for a predetermined area.

The display unit 1 of this embodiment is a CRT display. In this embodiment, the display unit 1 serves as a main component of a map displaying means 106 shown in FIG. 1.

The sensor group 2 of this embodiment includes a magnetic direction sensor for sensing the travel direction of the vehicle by utilizing geomagnetism, and one or more sensors for sensing a wheel speed difference of the vehicle. The sensors 2 serve as main components of a sensing means 103, shown in FIG. 1, for sensing operating conditions of the vehicle on which this display system is mounted.

The display mode selector switch 3 is a device for selecting one of a normal road network display mode (a first mode) and a congestion display mode (a second mode). In the road network display mode, all (registered) roads around the current vehicle position are displayed, and conditions of traffic congestion are not displayed. In the congestion display mode of this embodiment, only monitored roads are displayed with stepwise graphic gradation indicating degrees of congestion. The display mode selector switch 3 serves as a main component of a display mode selecting means 102 shown in FIG. 1. The display mode selector switch 3 is a manual switch which can be operated by the driver, and has at least two select positions for selecting the normal road display mode and the congestion display mode. The selector switch 3 produces a selector signal which is put in one of a road display mode select state (second select state) and a congestion display mode select state (first select state).

Figure 1:
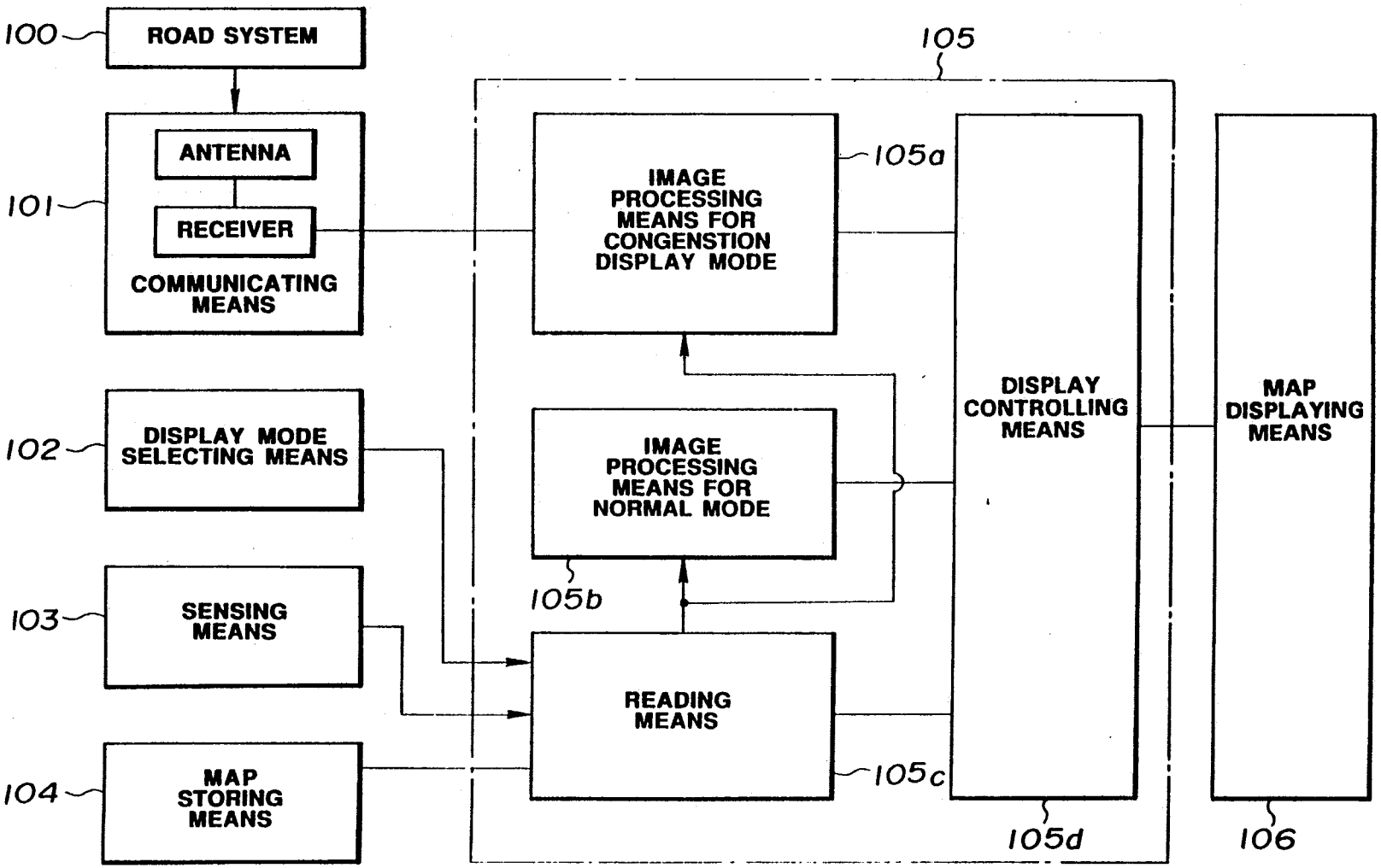
FIG. 1 is a block diagram showing one arrangement of various means used in the present invention.

The beacon receiver 4 can receive traffic information on congestion from a road system 100 shown in FIG. 1.

The beacon receiver 4 serves as a main component of a communicating means 101 shown in FIG. 1. In the example of FIG. 1, the communicating means 101 comprises the beacon receiver and an onboard antenna connected with the beacon receiver. The onboard antenna is mounted on the vehicle and designed to receive radio signals from the road system. The road system comprises roadside facilities for monitoring roads to detect traffic densities and speeds, and transmitting traffic information to vehicles.

The CD-ROM disc 5 stores data on a map or maps. For example, a map or maps representing the whole of Japan is stored in the CD-ROM disc 5. The CD-ROM disc or discs 5 and the CD-ROM driver 6 are main components of a map storing means 104 shown in FIG. 1.

The display system further includes a processor 7 for controlling road map images. The processor 7 includes a graphic display controller section 71 having a VRAM for storing picture images, an interface section 72, a well-known DMA section 73, a CPU 74, a ROM 75 for storing a display control program, and a RAM 76 for storing various data. The graphic display controller section 71 is connected with the display 1, and designed to cause the display 1 to produce road map images. The interface section (or interface circuit) 72 is connected with the sensors 2, the display mode selector switch 3 and the beacon receiver 4 to receive signals therefrom. The DMA section 73 is connected with the CD-ROM driver 6, and designed to transmit map information from the CD-ROM 5 to the VRAM of the graphic display controller section 71. The processor 7 serves as a main component of a processing means 105 shown in FIG. 1, and the graphic display controller section 71 serves as a component of a display controlling means **105*d* shown in FIG. 1**.

Figure 3:
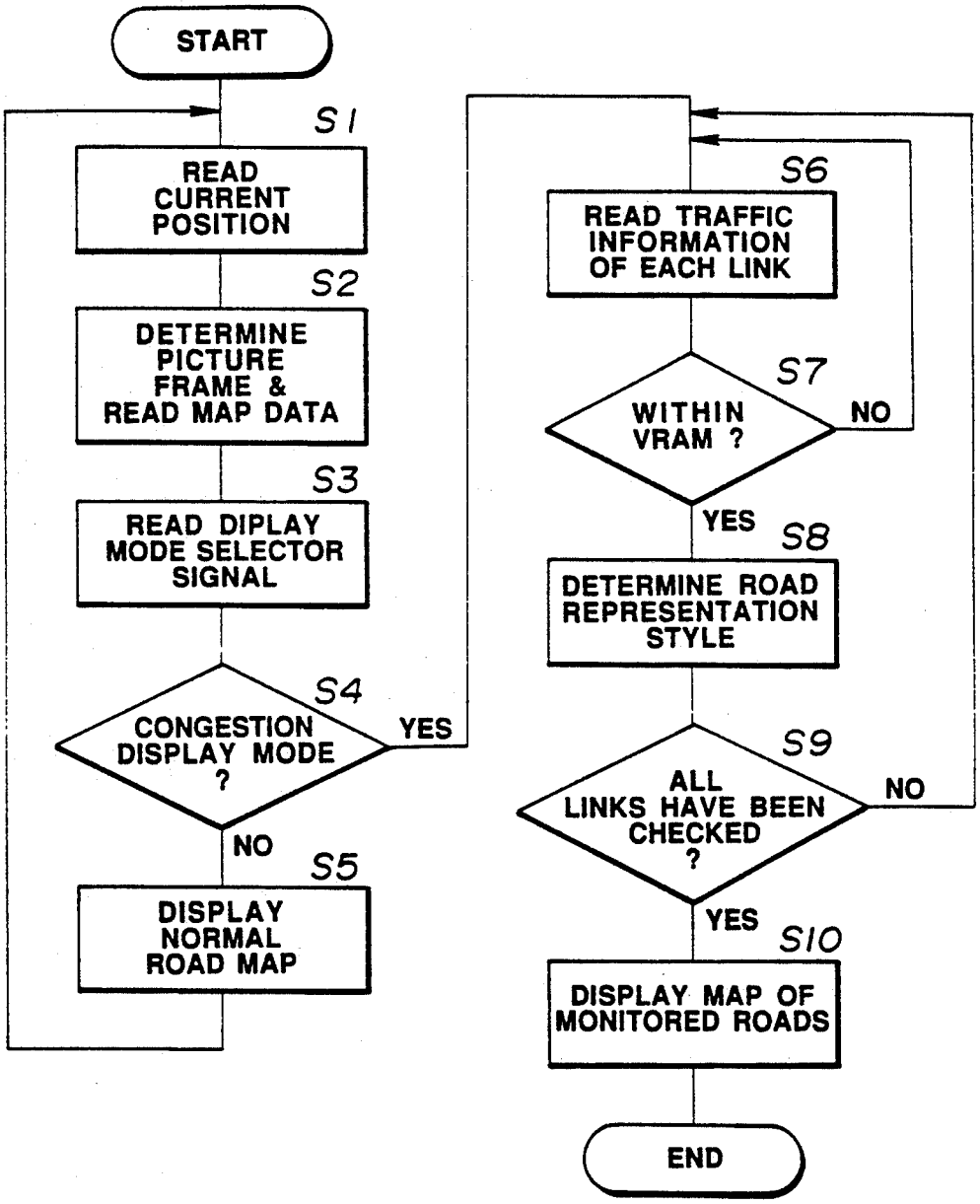
FIG. 3 is a flow chart showing a display control program used in the display system according to the first embodiment.

FIG. 3 shows the display control program stored in the ROM 75 of this embodiment of the invention. The CPU 74 executes the display control program periodically, every second, for example.

At a step S1 of the control program, the CPU 74 reads data on the vehicle's travel direction and travel distance sensed by the sensors 2, and determines the current vehicle position by comparing the input data to the road map data. At a step S2, the CPU 74 determines picture limits (or frame) so that the current vehicle position is placed at the center of the screen of the display 1. Then, the CPU 74 obtains the map data items within the determined picture limits from the CD-ROM 5 through the CD-ROM driver 6 and the DMA 73, and place the data items in the VRAM of the display control section 71.

Figure 4:
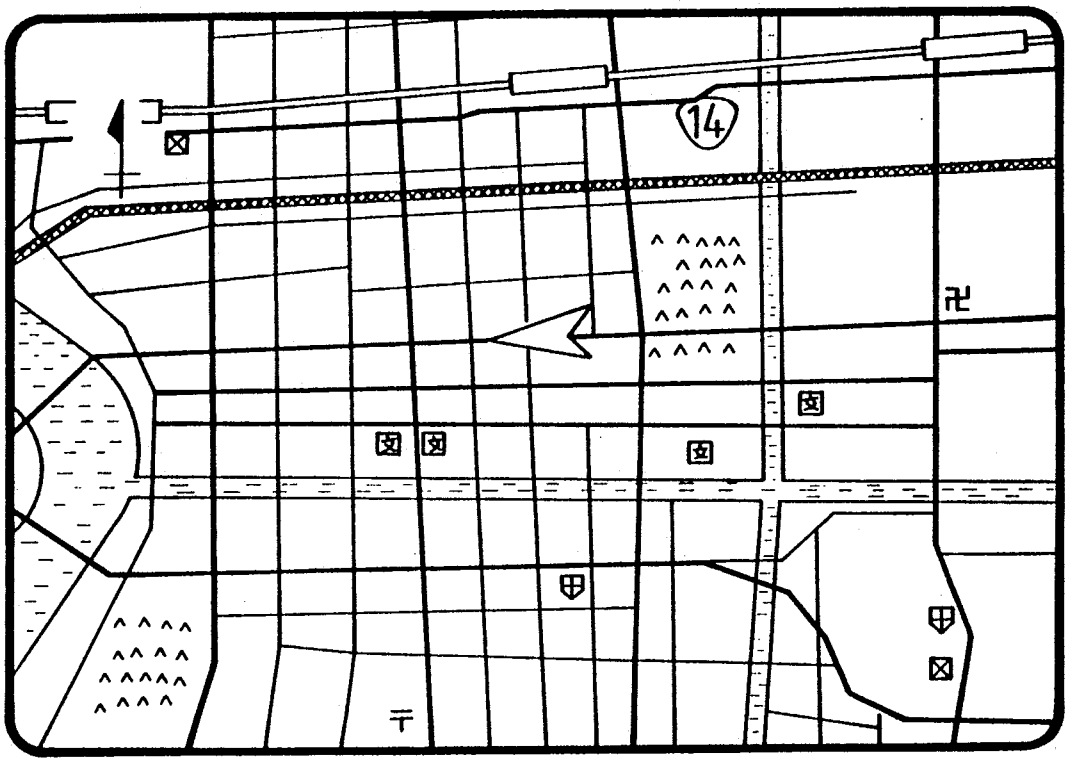
FIG. 4 is a view showing one road map image according to a normal road map display mode, produced by the display system of FIG. 2.

At a step S3, the CPU 74 reads the selector signal sent from the display mode selector switch 3, and determines whether the congestion display mode is selected. If the congestion display mode is selected by the selector switch 3, then the CPU 74 proceeds from the step S4 to a step S6. If the normal road display mode is selected, then the CPU 74 proceeds to a step S5. At the step S5, the CPU 74 causes the display 1 to produce a road map image in the normal mode as shown in FIG. 4. The current vehicle position stored in the VRAM is held at the center of the displayed map. The example of FIG. 4 (and FIG. 5) shows a map of one district of Tokyo with symbols which are used in Japan to indicate school, hospital, post office, temple et cetera. As a matter of course, it is possible to store a road map of any part of the world in the CD-ROM(s) 5, and to produce a map image on the screen of the display unit 1 with symbols and drawing styles fit for average drivers in that area.

Figures 5, 6:
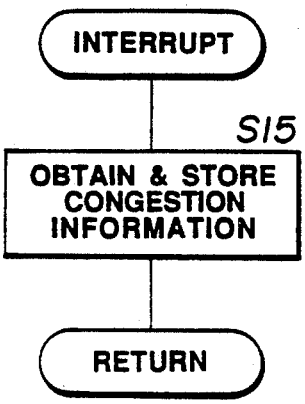
FIG. 5 is a flow chart showing an interrupt routine used in the display system of FIG. 2 to obtain traffic information.
FIG. 6 is a table showing, as an example, traffic data items used in the display system of FIG. 2.

When the selector switch 3 is put in the position for selecting the congestion display mode, an interrupt is produced to cause the CPU 74 to execute an interrupt routine shown in FIG. 5 each time the vehicle passes the position of a roadside beacon transmitter of the road system. At a step S15 of the interrupt routine, the CPU 74 receives real time traffic information on congestion through the beacon receiver 4 from each of the roadside beacon transmitters, and places the received information in the RAM 76. The traffic information in this embodiment is in the form of a list of data on congested states of all of roads which are monitored by the road monitoring system. FIG. 6 shows one example. In this example, the list includes a plurality of data sets each including a mesh number of the map, a link (crossing) number and an average running speed of the link. In one example, the link is a road section between two points, and each road is divided into links which are road sections. For example, links are road sections between two crossings. In this embodiment, the average running speed of vehicles is used as a degree of traffic congestion.

Figure 8:
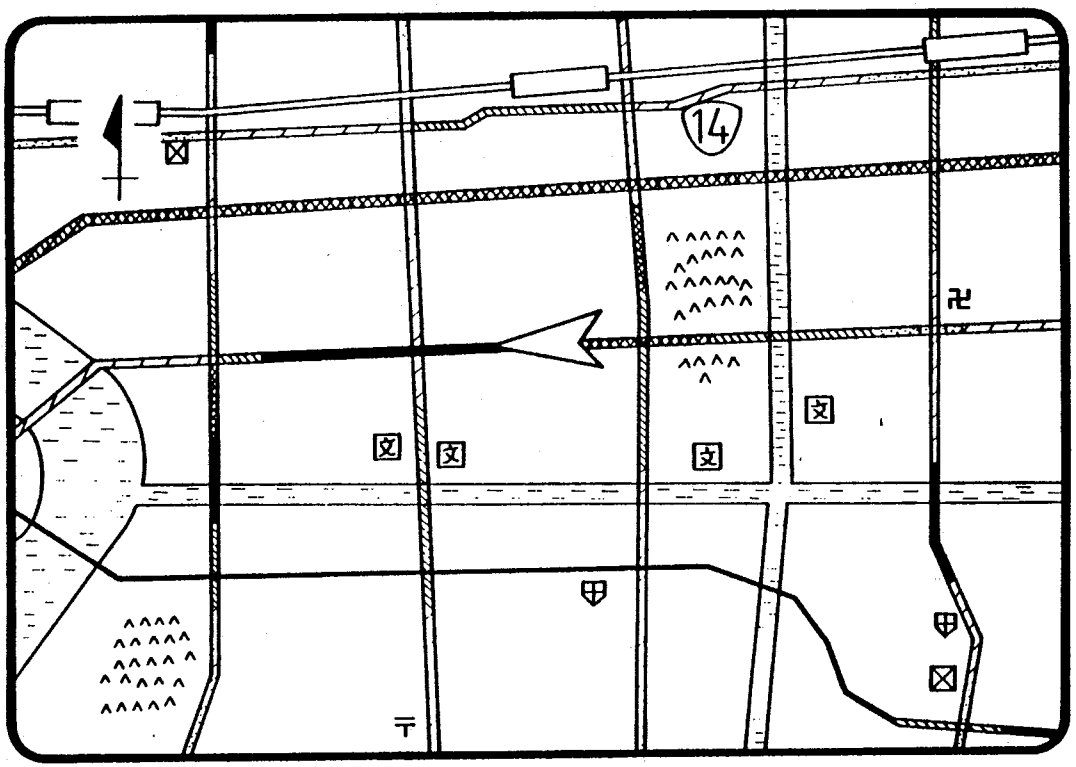
FIG. 8 is a view showing a road map image produced by the display system of FIG. 2 according to a congestion display mode.

At the step S6 of the main control program shown in FIG. 3, the CPU 74 reads the data items on traffic congestion of one link. At a next step S7, the CPU 74 determines whether the link whose data has been obtained at the step S6 is found in the map data around the current vehicle position which are stored in the VRAM. If the link being currently examined is found in the stored map data, then the CPU 74 proceeds to a step S8. If the link is not found, the CPU 74 returns to the step S6 to obtain the data of a next link. At the step S8, the CPU 74 determines a graphic style (representation type) of the link according to the average speed (or the traffic speed or the degree of traffic congestion) in the link. At a step S9, the CPU 74 determines whether all the links in the received traffic information have been checked or not. If all the links have been examined, then the CPU proceeds to a step S10. Otherwise, the CPU 74 returns from the step S9 to the step S6. In this way, the CPU 74 obtains the data items of all the links one link after another, and determines the graphic representation of each section of the monitored roads around the vehicle. The display system of this embodiment employs graphic styles shown in FIG. 7. It is possible to employ different colors to represent roads of different congestion grades. At the step S10, the CPU 74 deletes the data items on unmonitored roads among the map data stored in the VRAM, and commands the display 1 to produce a road map image in the congestion display mode. The unmonitored roads are roads which are not monitored by the monitoring system, so that real time traffic information is not available. In the map of the congestion display mode, each link of each monitored road is represented by the graphic symbol corresponding to the average speed in that link, as shown in FIG. 8. The unmonitored roads are not displayed, and only the monitored roads are displayed with an arrow indicating the current vehicle position, and other symbols for indicating railroads and ground facilities.

In the first embodiment, the display system is arranged to receive the traffic information of all the monitored roads through the beacon receiver 4. However, the amount of information which the onboard beacon receiver 4 can receive is limited especially when the vehicle speed is high. In some cases, therefore, it is desirable to reduce the amount of information which must be transmitted from the transmitter to the receiver 4.

Figure 9:
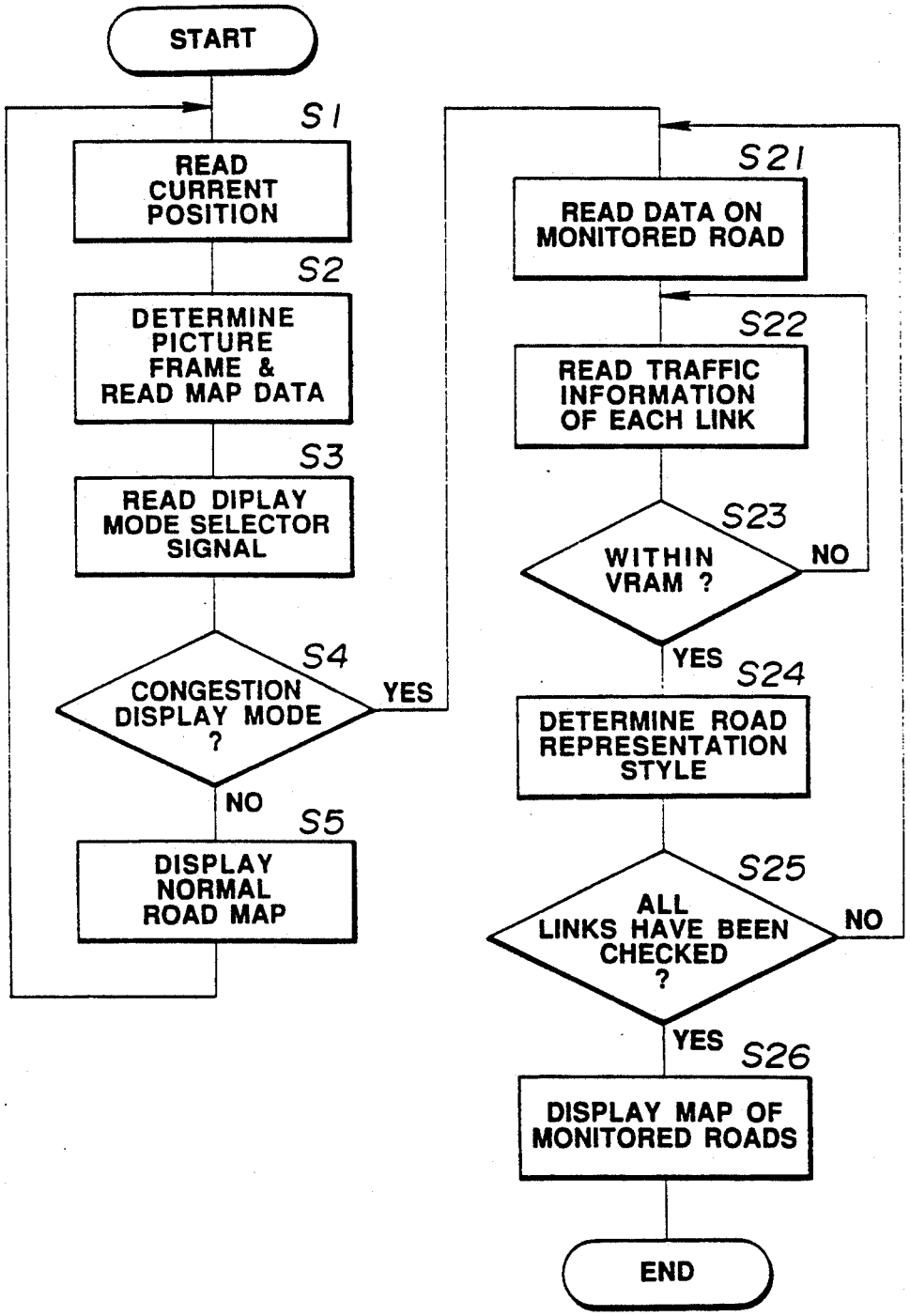
FIG. 9 is a flow chart used in a road map display system according to a second embodiment of the present invention.

A road map display system according to a second embodiment of the present invention is designed to reduce the amount of information transmitted by radio communication. The display system of the second embodiment is constructed in the same manner as the display system of the first embodiment shown in FIG. 2. In the second embodiment, the data of the monitored roads are preliminarily stored in the CD-ROM disc 5. Each beacon transmitter is designed to transmit only traffic information of monitored roads which are actually congested. No information is transmitted on the monitored roads which are not congested. FIG. 9 shows a display control program employed in the second embodiment. Steps S1–S5 are identical to the steps S1–S5 of FIG. 3. The CPU 74 of the second embodiment receives real time traffic information on the actually congested monitored road by performing the interrupt routine shown in FIG. 5, and stores the information in the RAM 76. Therefore, the display system of the second embodiment receives only traffic information of the actually congested roads among all the monitored roads. It is not necessary to receive information on the remaining monitored roads which are currently free from traffic jam. The amount of information to be transmitted is reduced as compared with the first embodiment.

At a step S21, the CPU 74 of the second embodiment reads the data of the monitored roads from the CD-ROM 5 together with other map data, and places the data in the VRAM. These map data items are data items within the picture limits (frame) determined at the step S2 to set the current vehicle position at the center of the map. At step S22, the CPU 74 reads the congestion information of one link among the actually congested monitored roads from the RAM 76. At a step S23, the CPU 74 determines whether the currently examined link is within the map data around the current vehicle position, stored in the VRAM. If it is, then the CPU 74 proceeds to step S24. If it is not, the CPU 74 returns to the step S22 to check the congestion information of a next link in a predetermined sequence. At the step S24, the CPU 74 determines the road representation style of the link corresponding to the average speed of the link. At a step S25, the CPU 74 determines whether all the links of the actually congested monitored roads have been checked. If all links have been checked, the CPU 74 proceeds to a step S26. If one or more links remain unchecked, the CPU 74 returns to the step S21. The CPU 74 of the second embodiment draws images of the roads which are monitored but not congested, by using the representation style corresponding to the average speed of 40 km/h shown in FIG. 7. At the step S26, the CPU 74 commands the display 1 to draw a picture of the map by using the map data stored in the VRAM. In the map on the screen of the display 1, the actually congested monitored roads are represented with stepwise gradation by the styles corresponding to the respective traffic speeds, and the non-congested monitored road (or roads) is represented by the graphic style corresponding to the traffic speed of 40 km/h, as shown in FIG. 8.

In road map images of the congestion display mode, it is possible to make the unmonitored roads less clear than the monitored roads without completely erasing the unmonitored roads.

FIG. 1 shows interconnections among the various means employed in the first and second embodiments. The entire road-vehicle system shown in FIG. 1 includes the road system 100, and the onboard road map display system including the communicating means 101, display mode selecting means 102, sensing means 103, map storing means 104, processing means 105, and map displaying means 106. In the example shown in FIG. 1, the processing means comprises a first image processing means 105*a* for the congestion display mode, a second image processing means 105*b* for the normal road display mode, a reading means 105*c* and a display controlling means 105*d*. The reading means 105*c* corresponds to the program section of the steps S1–S4 shown in FIGS. 3 and 9. The second image processing means 105*b* corresponds to the step S5 shown in FIGS. 3 and 9. The first image processing means 105*a* corresponds to the program section of the steps S6–S10 shown in FIG. 3 or the program section of the steps S21–S26 shown in FIG. 9. The display controlling means 105*d* corresponds to the graphic display controller section 71 including VRAM shown in FIG. 2.

I claim:

1. An onboard road map display system mounted on a vehicle, said display system comprising:

a communicating means for performing road-vehicle communication to receive traffic information on traffic congestion on monitored roads in which traffic conditions are monitored a map storing means for storing map data representing a map of roads;

a map displaying means for displaying a road map around a current vehicle position of the vehicle and congested road sections;

a display mode selecting means for selecting one of a first display mode in which said monitored roads around said current vehicle position of the vehicle are displayed in a map together with unmonitored roads in which traffic conditions are not monitored, and a second display mode in which a map of only said monitored roads around the current vehicle position is displayed; and a processing means for causing said map displaying means to display a road map image according to a selected one of said first and second display modes;

wherein said processing means comprises a discriminating means for discriminating between said monitored roads and said unmonitored roads by using one of said traffic information received by said communicating means and said map data stored in said map storing means.

2. An onboard road map display system according to claim 1 wherein said display system further comprises wherein said processing means includes a means for producing road map images by using only said map data of said map storing means when said first display mode is selected, and for producing road map images by using said traffic information when said second display mode is selected.

3. An onboard road map display system mounted on a vehicle, said display system comprising:

a communicating means for receiving traffic data by performing road-vehicle communication, said traffic data comprising congestion data for discriminating a congested road section of monitored roads about which traffic information is available, from an uncongested road section of said monitored roads;

a map displaying means for displaying road map images;

a map storing means for storing map data representing a map of roads; and a first image processing means for discriminating said monitored roads comprising said congested road section and said uncongested road section and unmonitored roads about which traffic information is unavailable, and for causing said displaying means to display a road map image so that said monitored roads are distinguishable from said unmonitored roads, and said congested road section is distinguished from said uncongested road section;

wherein said first image processing means comprises a discriminating means for discriminating between said monitored roads and said unmonitored roads by using one of said traffic data received by said communicating means and said map data stored in said map storing means.

4. An onboard map display system according to claim 3 wherein said display system further comprises a display mode selecting means for producing a selector signal which is in one of first and second select states, and a second image processing means for causing said display means to display road map images by using only said map data when said selector signal is in said second select state, said first image processing means causing said displaying means to display road map images by using both of said map data and said traffic data when said selector signal is in said first select state.

5. An onboard road map display system according to claim 4 wherein said first image processing means includes a means for examining said traffic data which comprise a data item representing a degree of traffic congestion in each of road sections of said monitored roads, determining graphic styles for drawing said road sections of said monitored roads according to said degrees of traffic congestion of said road sections, and making said monitored roads distinguishable from said unmonitored roads in map images produced by said displaying means when said selector signal is in said first select state.

6. An onboard road map display system according to claim 5 wherein said display sytstem further comprises a display controlling means for storing a part of said map data required to produce a map image, and said first image processing means includes a means for deleting a part of said map data representing said unmonitored roads when said selector signal is in said first select state.

7. An onboard road map display system according to claim 6 wherein said display system further comprises a sensing means for determining a current vehicle position of the vehicle, and a reading means for transferring a part of said map data required to produce a road map image around said current vehicle position from said map storing means to said display controlling means.

8. An onboard road map display system according to claim 7 wherein said first image processing means includes a discriminating means for discriminating between said monitored roads and said unmonitored roads by using said traffic data received by said communicating means.

9. An onboard road map displaying system according to claim 7 wherein said first image processing means includes a discriminating means for discriminating between said monitored roads and said unmonitored roads by using said map data stored in said map storing means.

10. An onboard road map display system according to claim 4 wherein said communicating means comprises a beacon receiver, said map displaying means comprises an electronic display device for converting electric signals into visual imagery, a map storing means comprises a CD-ROM driver, and said display mode selecting means comprises a manual selector switch.

11. An onboard road map display system mounted on a vehicle, said display system comprising:

a receiver for receiving traffic information by performing road-vehicle communication, said traffic information comprising a list of a plurality of traffic data sets each set comprising a first traffic data item for identifying a monitored road section in which a traffic condition is monitored, and a second traffic data item for indicating a degree of traffic congestion in said monitored road section;

a sensor for determining a current vehicle position of said vehicle;

a map storage device for storing map information representing a map of roads;

a display device for displaying road map images;

a display mode selector for selecting one of first and second road map display modes; and an image processor for reading a collection of map data items contained in the map information from said map storage device and causing siad display device to display a first mode road map image around said current vehicle position by using the collection of the map data items when said first road map display mode is selected by said display mode selector, and for processing the collection of the map data items in accordance with the traffic information received by said receiver and causing said display device to produce a second mode road map image when said second road map display mode is selected by said display mode selector, said display device responsive to said image processor when said first road map display mode is selected by displaying, in said first mode road map image, images of first, second and third road sections, said processor discriminating the first and second road sections, each of which is identified by one of said first traffic data items received by said receiver, from the third road section which is not identified by said first traffic data items, said display device responsive to said image processor when said second road map display mode is selected by displaying, in said second mode road map image, images of said first and second road sections with a visible display of a degree of traffic congestion in each of said first and second road sections.

12. An onboard road map display system according to claim 11 wherein said processor comprises means for examining the traffic information received by said receiver, determining a graphic style for causing said display device to display each of the first, second and third road map sections in said second mode road map image, to display the degree of traffic congestion in the second road section at a minimum value to indicate that the second road section is not congested, to display the degree of traffic congestion in the first road section at a value which is greater than said minimum value to indicate that the first road section is congested, the graphic style of the second road section being different from the graphic style of the first road section, the graphic style of the third road section being different from the graphic style of the second road section.

13. An onboard road map display system according to claim 11 wherein said processor comprises means for deleting one of the map data items of said collection so that the third road section is not displayed in said second mode road map image.

14. An onboard road map display system according to claim 11 wherein said processor comprises a memory section for storing said collection of the map data items each of which represents a unique one of the first, second and third road sections and other road sections displayed in said first mode road map image, and a processing unit responsive to selection of said second road map display mode by classifying the map data items of said collection stored in said memory section into first and second groups by examining said first traffic data items received by said receiver, the road section represented by each of the map data items belonging to said first group being one of the monitored road sections identified by one of said first traffic data items received by said receiver, and the road section represented by each of the map data items belonging to said second group being a road section identified by none of said first traffic data items.

15. An onboard road map display system according to claim 14 wherein said processing unit is responsive to selection of said second road map display mode by erasing the map data items of said second group from said memory section.

* * * * *